US006649009B1

(12) United States Patent
Kim

(10) Patent No.: US 6,649,009 B1
(45) Date of Patent: Nov. 18, 2003

(54) PROCESS FOR PLACING ONE FACETED STONE INSIDE A LARGER FACETED STONE TO FORM A SINGLE JEWELRY STONE

(76) Inventor: John Kim, c/o K2 International Corp. 22 W. 32nd St., 9th floor, New York, NY (US) 10001

( * ) Notice: Subject to any disclaimer, the term of this patent is extended or adjusted under 35 U.S.C. 154(b) by 0 days.

(21) Appl. No.: 10/230,806

(22) Filed: Aug. 29, 2002

(51) Int. Cl.[7] ..... B32B 31/00; A44C 17/02

(52) U.S. Cl. ..... 156/257; 156/268; 156/63; 156/254; 156/292; 156/293; 83/13; 83/861; 63/32

(58) Field of Search ..... 156/257, 268, 156/63, 254, 292, 293; 63/32; 83/13, 861

(56) References Cited

U.S. PATENT DOCUMENTS

| | | | |
|---|---|---|---|
| 286,023 | A | 10/1883 | Lancon |
| 1,421,329 | A | 6/1922 | Welch |
| 1,730,257 | A | 10/1929 | Welch |
| 1,912,602 | A | 6/1933 | Stonberg |
| 2,447,407 | A | 8/1948 | Grain |
| 3,835,665 | A | 9/1974 | Kitchel |
| 4,809,417 | A | 3/1989 | Normann, Jr. |
| 4,942,744 | A | 7/1990 | Wei |
| 5,090,216 | A | 2/1992 | Waugh |
| 5,432,988 | A | 7/1995 | Woo |
| 5,454,234 | A | 10/1995 | Karmeli |
| 6,025,060 | A | 2/2000 | Meissner |

FOREIGN PATENT DOCUMENTS

| | | |
|---|---|---|
| FR | 2621230 | 7/1998 |
| JP | 6-327509 | * 11/1994 |

* cited by examiner

*Primary Examiner*—Linda Gray
(74) *Attorney, Agent, or Firm*—Michael I Kroll

(57) ABSTRACT

A decorative jewelry stone and process for developing the stone. The process includes providing a primary stone and defining a cutting plane on the primary stone. The primary stone is then cleaved at the cutting plane to produce first and second portions, each of the first and second portions having a planar surface. A cavity is then bored into the planar surface of one of the first and second portions of the primary stone. A secondary stone is then placed within the cavity and a bonding agent is applied to the planar surface of one of the first and second portions. The planar surfaces of the first and second portions are then placed against one another allowing the bonding agent to cure and thereby permanently fix the first and second portions together sealing the secondary stone therebetween. The cavity may be dimensioned to be substantially equal to a size of the secondary stone so that the secondary stone fits tightly within the cavity or substantially larger in size than the secondary stone so that the secondary stone fits loosely within said cavity thereby allowing the secondary stone to move freely. The bonding agent includes a transparent UV curing agent and a transparent heat-curing agent.

6 Claims, 11 Drawing Sheets

PROCESS FOR PLACING ONE FACETED STONE INSIDE A LARGER FACETED STONE TO FORM A SINGLE JEWELRY STONE

BACKGROUND OF THE INVENTION

1. Field of the Invention

The present invention relates generally to methods for manufacturing jewelry stones and, more specifically, to a method for cleaving a faceted primary gemstone and boring the planar surface thereof to form a cavity to retain a secondary gemstone therein. The two cleaved portions of the primary stone are then bonded together sealing the secondary gemstone therebetween.

2. Description of the Prior Art

Gemstones are minerals that for centuries have been treasured for their beauty and durability. There are three types of gemstones: natural, synthetic, and simulant. Natural gemstones include minerals used as faceting, lapidary, or carving rough, and specimen. Natural gemstones also include organic materials such as amber, coral, fossil, ivory, mother of pearl, natural and cultured freshwater pearls, and natural saltwater pearls.

Synthetic and simulant are laboratory-grown gemstones. Others in the gemstones industry may use different terms to refer to laboratory grown gemstones. Laboratory grown synthetic gemstones have essentially the same appearance and optical, physical, and chemical properties as the natural material that they represent. Laboratory grown simulants on the other hand, have an appearance similar to that of a natural gemstone but have different optical, physical, and chemical properties.

Gemstone quality and value are evaluated according to the "four Cs": color, clarity, cut, and carat weight. Color is the key factor. In general, within each gemstone variety, a clear, medium-tone, very intense and saturated primary color is the most preferred. The next most important factor affecting value is clarity, with clear transparent gemstones with no visible flaws being the most valued. A good cut is something that may not cost more but can add or subtract a lot of beauty. A well-cut faceted gemstone reflects light back evenly across its surface area when held face up. Gemstones are generally sold by weight not by size. The unit of measure is carat, which is one-fifth of a gram.

There are methods of manufacturing jewelry stones. Typical of these is U.S. Pat. No. 286,023 issued to G. Lancon on Oct. 2, 1883.

A patent was issued on Jun. 27, 1922 as U.S. Pat. No. 1,421,329 to H. H. Welch. Another patent was issued to H. H. Welch on Oct. 1, 1929 as U.S. Pat. No. 1,730,257. Yet another U.S. Pat. No. 2,447,407 was issued to M. Grain on Aug. 17, 1948 and still yet another was issued on Jun. 6, 1933 to S. Stonberg as U.S. Pat. No. 1,912,602.

U.S. Pat. No. 3,835,665 was issued to G. B. Kitchel on Sep. 17, 1974. Another patent was issued to Normann, Jr. on Mar. 7, 1989 as U.S. Pat. No. 4,809,417. Yet another U.S. Pat. No. 4,942,744 was issued to H. C. Wei on Jul. 24, 1990 and still yet another was issued to J. T. Waugh on Feb. 25, 1992 as U.S. Pat. No. 5,090,216.

Another patent was issued to C. C. Woo on Jul. 18, 1995 as U.S. Pat. No. 5,432,988. U.S. Pat. No. 5,454,234 was issued on Oct. 3, 1995 to D. W. Karmeli and on Feb. 15, 2000 H. E. Meissner was issued U.S. Pat. No. 6,025,060. Gilles Goineau was issued French Patent No. FR2621230 on Apr. 7, 1989.

While these methods of manufacturing jewelry stones may be suitable for the purposes for which they were designed, they would not be as suitable for the purposes of the present invention, as hereinafter described.

U.S. Pat. No. 286,023

Inventor: Gedeon Lancon

Issued: Oct. 2, 1883

An imitation gem composed of garnet or other suitable stone cut in two parts, hollowed out and containing a core or filling of colored enamel, substantially as described.

U.S. Pat. No. 1,421,329

Inventor: Horace H. Welch

Issued: Jun. 27, 1922

A finger ring having a setting, and artificial gem secured therein, said gem comprising a hollow body, and a sufficient number of loose brilliant display elements housed and movable in said body to give to the gem as a whole the appearance of internal mobility upon movement of the gem, said body being sufficiently translucent to render visible therethrough the moving brilliant display elements.

U.S. Pat. No. 1,730,257

Inventor: Horace H. Welch

Issued: Oct. 1, 1929

The improvement in a composite gem of the type comprising a group of a multiplicity of small gems immersed and movable in a substantially transparent housing wherein the liquid spaces apart the small gems when they are set in motion therein, said improvement consisting of a plurality of substantially transparent spacing pieces intermingled with the small gems and mobile in the liquid and having the property relative to the liquid which causes them to be substantially indistinguishable optically when in the liquid.

U.S. Pat. No. 1,912,602

Inventor: Samuel Stonberg

Issued: Jun. 6, 1933

The combination of a hollow diaphanous body member, a plurality of gem elements therein, and a quantity of s-tetrabromoethane surrounding said elements and diluted sufficiently to provide a specific gravity substantially equal to that of said elements.

U.S. Pat. No. 2,447,407

Inventor: Mark Grain

Issued: Aug. 17, 1948

A faceted gem having an opening in the lower central portion thereof, a smaller faceted gem adapted to fit within said opening which permits it to revolve and move slightly therein, a closure for said opening, said smaller gem resting upon said closure whereby greater brilliance is obtained.

U.S. Pat. No. 3,835,665

Inventor: George Behrman Kitchel

Issued: Sep. 17, 1974

A gem of material for transmitting ambient light comprising: a crown having a plurality of facets; a pavilion having a plurality of facets; and means embedded within the pavilion for reflecting a colored light portion of said transmitted ambient light, said means coacting with said facets for causing a variable dispersed pattern of said reflected light and other transmitted light to be visible in the facets of said crown.

U.S. Pat. No. 4,809,417

Inventor: George W. Norman, Jr.

Issued: Mar. 7, 1989

A multiplet jewelry product constructed of two or more layers of material affixed together having visual indicia secured therebetween is disclosed. Affixation is preferably accomplished using adhesive materials. The top layer of the multiple jewelry product is constructed of a material sufficiently transparent to permit observation of the visual indicia. Subsequent layers of material consist of a selected transparent, semi-transparent or non-transparent gemstone materials. Visual indicia usable in the invention include symbolic representations, words, alphabet letters, pictures, designs, or objects. The completed product represents an attractive and unique jewelry item having an unusual and aesthetically desirable visual appearance.

U.S. Pat. No. 4,942,744

Inventor: Hsu C. Wei

Issued: Jul. 24, 1990

It is a self-shining artificial jewelry device, which mainly comprises a piece of artificial jewel having a cavity, an illuminating element being mounted inside the cavity, of which the inner surface is furnished with a plurality of facets. The outer facets of the artificial jewel are coated with a colored coating. When the illuminating element is lighted up, the light will be reflected repeatedly through the inner facets, the outer facets, and the colored coating to generate a brilliant and splendid shining; this jewelry device may be used to replace the expensive jewels and the natural crystal elements, which are deemed to have poor shining result.

U.S. Pat. No. 5,090,21

Inventor: John T. Waugh

Issued: Feb. 25, 1992

An enhanced gemstone that has a semiprecious gemstone having a crown member with a table surface and a conical seat centered in the table surface. A precious stone is set in the conical seat with the pavilion member of the precious stone matching the angle of the conical seat. The precious stone is secured in the conical seat with means such as cement.

U.S. Pat. No. 5,432,988

Inventor: Chong C. Woo

Issued: Jul. 18, 1995

A method for setting a gemstone in a semi-precious stone, capable of achieving an easy setting and thereby greatly reducing the labor and the work time. The method includes the steps of preparing a gem stone having a girdle and upper and lower tapered surfaces disposed above and beneath the girdle, preparing a semi-precious stone including an upper semi-precious stone piece having a hole provided with an upwardly-tapered contact surface having the same taper angle as the upper tapered surface of the gem stone and a lower semi-precious stone piece having a hole provided with a downwardly-tapered contact surface having the same taper angle as the upper tapered surface of the gem stone, fitting the gem stone in the hole of the lower semi-precious stone piece such that the lower tapered surface thereof is in contact with the contact surface of the lower semi-precious stone piece, and bonding the upper semi-precious stone piece to the lower semi-precious stone piece such that the contact surface of the upper semi-precious stone piece is in contact with the upper tapered surface of the gem stone.

U.S. Pat. No. 5,454,234

Inventor: David D. Karmeli

Issued: Oct. 3, 1995

A jewelry stone assembly comprises upper and lower stone portions which are adhesively attachable to each other at mating surfaces. One or more blind cavities are formed in the mating surface of the lower stone portion and a jewel alone or jewel with setting is dropped into the cavity. Thereafter, clear adhesive is used to attach the upper and lower stone portions at their mating surfaces and the outer surface of the assembled outer stone is further processed, for example by faceting, to produce an outer stone which contains at least one inner stone.

U.S. Pat. No. 6,025,060

Inventor: Helmuth E. Meissner

Issued: Feb. 15, 2000

A method and apparatus for creating unique gemstones is provided. The method comprises the steps of optically contacting the gemstones of interest followed by a heat treatment of the composite gemstone. The heat treatment step increases the bond strength and therefore the resistance of the bond to reversal. In one aspect of the invention, a composite gem is fabricated by bonding a naturally occurring gem to an artificial gem to form a single composite gemstone of large size that outwardly appears to be a single natural gem. The composite gem may be fabricated at a fraction of the cost of a natural stone of the same size. In another aspect of the invention, an intensely colored natural stone is bonded to a colorless or lightly colored artificial stone. This composite retains the intense color associated with the natural stone while enjoying the brilliance, depth, and size resulting from the combination of stones. In another aspect of the invention, various composite gemstones are fabricated using a variety of stones of both natural and artificial origin. The stones may be layered with two, three, or more layers. The composite gem may either take the form of a simple layered gem, or the composite gem may be in the form of a variety of three-dimensional shapes. In another aspect of the invention, the composite gem includes an engraved pattern at one or more internal gem interfaces. The engraving is completed prior to bonding the stones together and may convey either a two-dimensional or a three-dimensional image.

French Patent Number FR2621230

Inventor: Gilles Goineau

Issued: Apr. 7, 1989

This system comprises a metal dish open at both it's ends, whose inner wall has a frustoconical shape and whose central opening is partially sealed off at it's small-section end by a central ring held by radial tabs, this dish serving for the engagement of a stone whose outer face has a profile complementing that of the dish, and whose upper face is shaped, this stone including a central hole serving for the passage of a member one end of which attaches removably on to the ring arranged at one end of the dish and whose other end, equipped end of which attaches removable on to the ring arranged at one end of the dish and whose other end, equipped with a stone, bears on the first stone and immobilizes the latter in the dish. Application to the production of motifs constituting rings, earrings, necklaces, etc.

SUMMARY OF THE PRESENT INVENTION

The present invention relates generally to methods for manufacturing jewelry stones and, more specifically, to a method for cleaving a faceted primary gemstone and boring the planar surface thereof to form a cavity to retain a secondary gemstone therein. The two cleaved portions of the primary stone are then bonded together sealing the secondary gemstone therebetween.

A primary object of the present invention is to provide a method of securing one faceted stone inside another that will overcome the shortcomings of prior art methods.

Another object of the present invention is to provide a method of securing one faceted stone inside another so the juxtaposition of the two faceted faces thereof form unique patterns and effects.

Still another object of the present invention is to provide a method of securing one faceted stone inside another by cleaving the larger primary stone in two and boring a cavity in a planar surface thereof for placing the smaller secondary stone therein.

Yet another object of the present invention is to provide a method of securing one faceted stone inside another wherein the secondary stone is secured within the primary stone when the two cleaved portions of the primary stone are bonded together using an adhesive or other appropriate bonding agent.

Still another object of the present invention is to provide a method of securing one faceted stone inside another wherein more than one secondary stone may be secured within the primary stone.

Another object of the present invention is to provide a method of securing one faceted stone inside another wherein the secondary stone may be free to move within the primary stone.

A still further object of the present invention is to provide a method of securing one faceted stone inside another that is simple and easy to perform.

Yet another object of the present invention is to provide a method of securing one faceted stone inside another that is inexpensive to manufacture and operate.

Additional objects of the present invention will appear as the description proceeds.

The present invention overcomes the shortcomings of the prior art by providing a method of securing one faceted stone inside another by using stones that are already finished so any extraneous stones may be used individually in other applications.

The present invention method for cleaving a faceted primary gemstone and boring the planar surface thereof to form a cavity to retain a secondary gemstone therein can be produced by either natural, synthetic, or simulant gemstone or in any combination of each type gemstone.

The present invention relates generally to methods for manufacturing jewelry stones and, more specifically, to a method for cleaving a faceted primary gemstone and boring the planar surface thereof to form a cavity to retain a secondary gemstone therein. The two cleaved portions of the primary stone are then bonded together sealing the secondary gemstone therebetween.

The present invention method for cleaving a faceted primary gemstone and boring the planar surface thereof to form a cavity to retain a secondary gemstone will reduce the carat weight, but the color, clarity, and cut are virtually unaffected. While the faceted primary gemstone maintains the brilliance reflected in the color, clarity and cut, the encapsulated secondary gemstone creates a jewelry stone unique and enhanced in appearance.

The cavity formed within the primary gemstone provides means for free movement of the encapsulated secondary gemstone. This free movement allows for a unique and more brilliant reflection of light that changes with the movement of the gemstones.

Like individual gemstones, no jewelry stone manufactured by means of the present invention will be alike. Because the faceted primary gemstone and the encapsulated secondary gemstone can be of the any type, the present invention allows for a multitude of colors, shapes and sizes.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

BRIEF DESCRIPTION OF THE DRAWING FIGURES

Various other objects, features and attendant advantages of the present invention will become better understood when considered in conjunction with the drawings, in which like reference characters designate the same or similar parts throughout the several views.

DESCRIPTION OF THE REFERENCED NUMERALS

Figure 1:
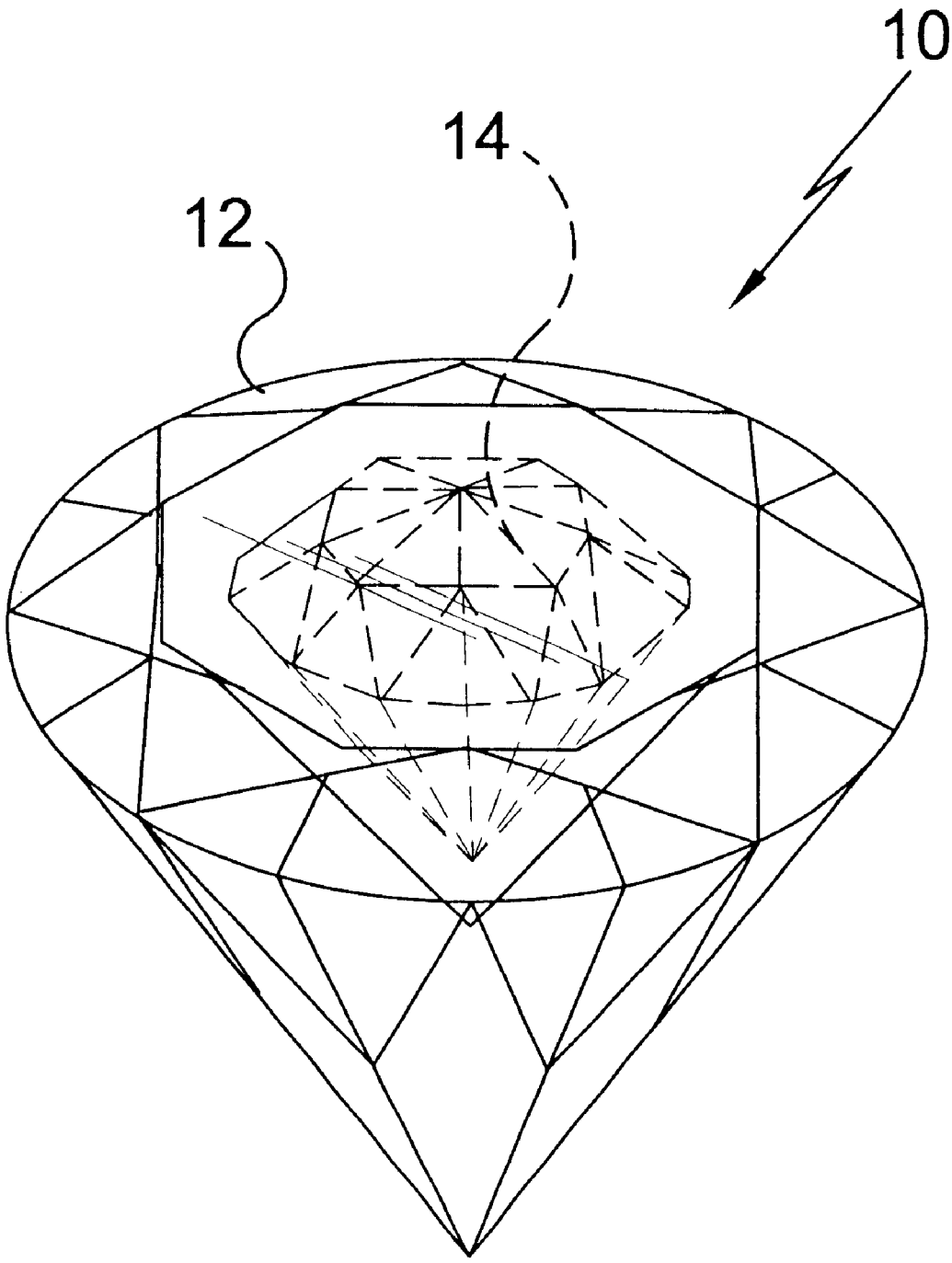
FIG. 1 is a perspective view of a secondary stone within a cavity of the primary stone created by the processes of the present invention.

Turning now descriptively to the drawings, in which similar reference characters denote similar elements throughout the several views, the Figures illustrate the final product of the method of encasing a gemstone within another gemstone of the present invention. With regard to the reference numerals used, the following numbering is used throughout the various drawing figures:

10 decorative jewelry stone

12 primary stone

14 secondary stone

16 upper portion of the primary stone

18 lower portion of the primary stone

20 cavity

22 planar surface

24 bonding agent

26 customer

28 plurality of stones

DETAILED DESCRIPTION OF THE PREFERRED EMBODIMENTS

The following discussion describes in detail one embodiment of the present invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings, in which similar reference characters denote similar elements throughout the several views. FIGS. 1–11 illustrate the method of securing one faceted stone inside another in accordance with the present invention.

FIG. 1 is a perspective view of a decorative jewelry stone 10 formed in accordance with the method of the present invention including a primary stone 12 and a secondary stone 14 imbedded therein. The decorative jewelry stone of the present invention 10 may be created through any combination of natural, synthetic, or simulant gemstones. Like individual gemstones, no two jewelry stones manufactured by means of the present invention will be alike. The present invention method for creating the decorative jewelry stone 10 will reduce the carat weight of the primary stone 12, but the color, clarity, and cut thereof are virtually unaffected. While the faceted primary stone 12 maintains the brilliance reflected on the color, clarity, and cut, the encapsulated secondary gemstone 14 creates a decorative jewelry stone 10 unique and enhanced in appearance.

Figure 2:
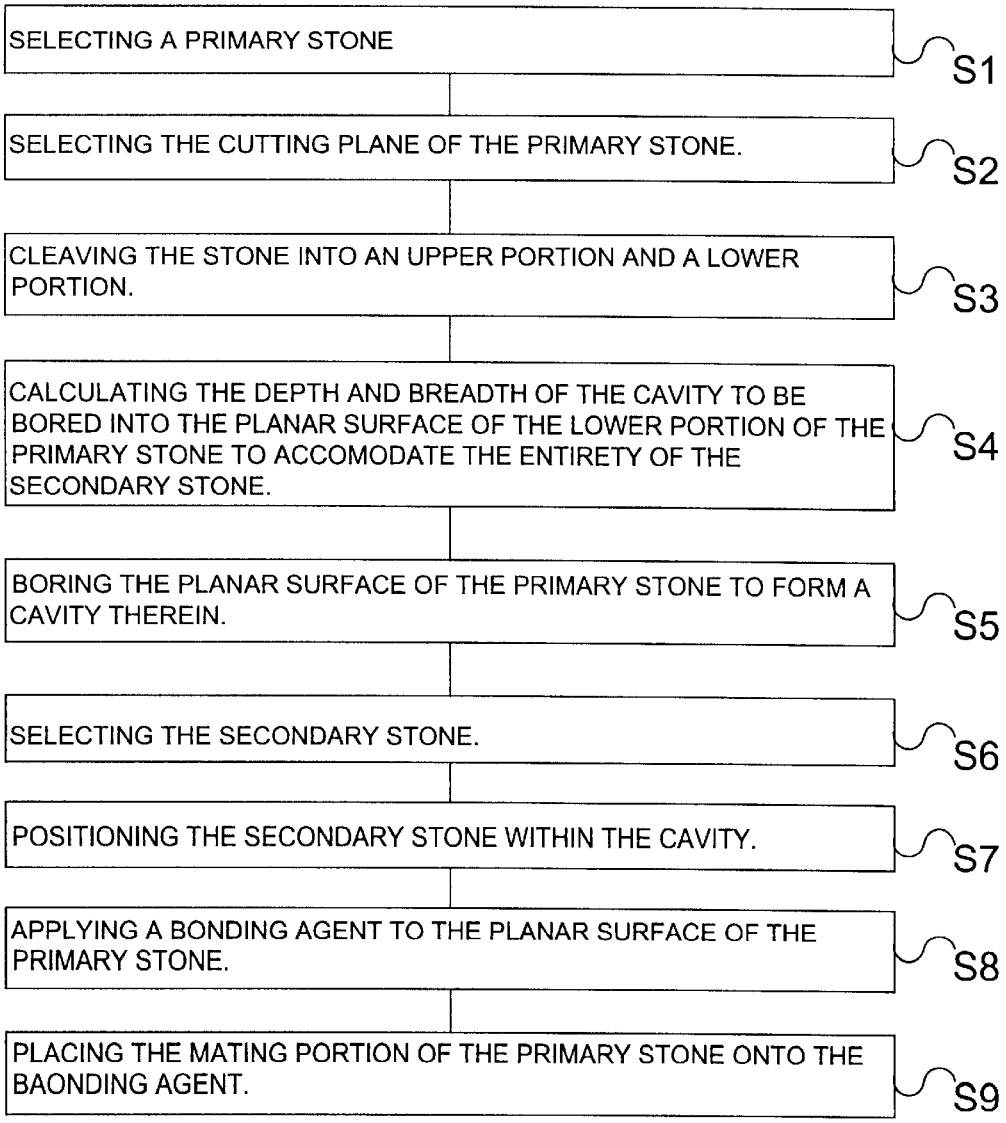
FIG. 2 is flow chart of the method of securing one faceted stone inside another in accordance with the present invention.
Figure 3:
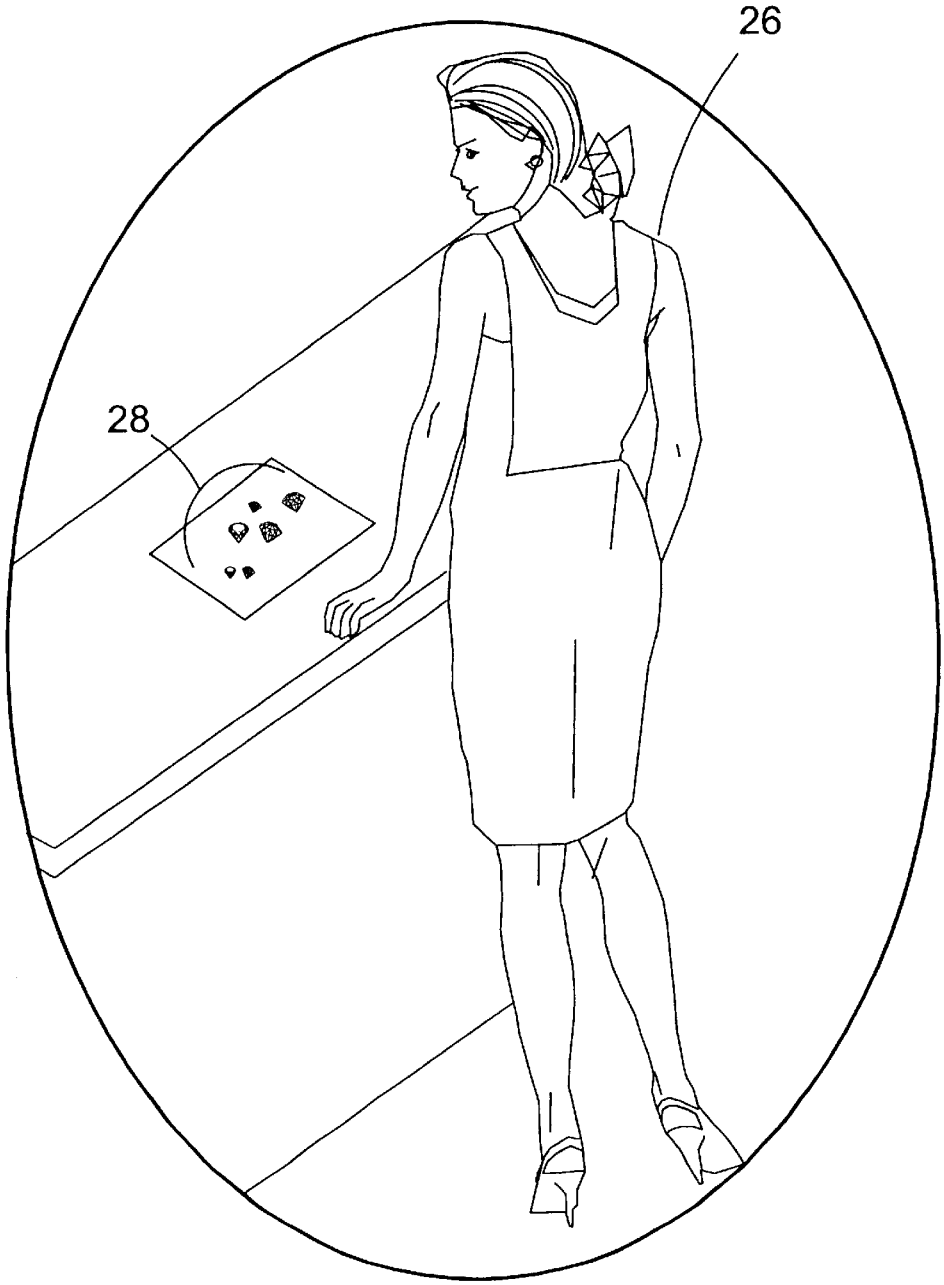
FIG. 3 is an illustrative view of a person selecting the stones to be used in performing the method of the present invention.

FIG. 2 is a flow chart demonstrating the method of the present invention. The first step S1 in creating the decorative jewelry stone 10 is to select a primary stone 12, as illustrated in FIG. 3. Selecting the primary stone 12 requires one to consider the carat weight, color, clarity, and cut of a potential gemstone. In evaluating these characteristics of a potential gemstone, the consumer should keep in mind that the procedure for creating the combined embodiment 10 will require a mostly transparent primary stone 12, and that the carat weight of the primary stone 12 will be reduced by the method of the present invention. FIG. 3 illustrates a customer 26 viewing a plurality of stones 28 for use as a primary stone.

Figure 4:
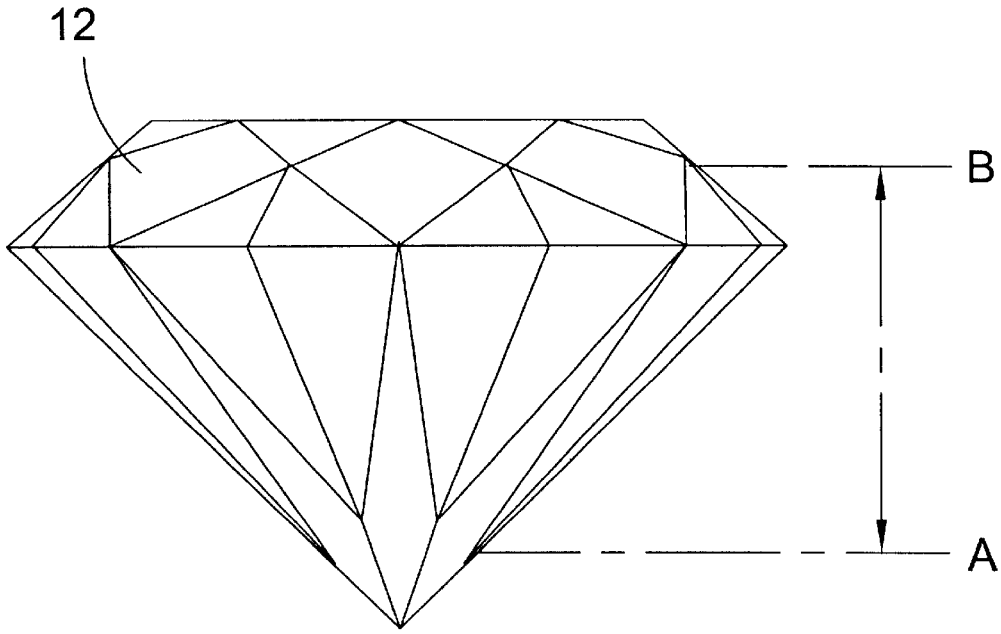
FIG. 4 is a side view of the primary stone used in the method of the present invention for illustrating the potential cutting planes.
Figure 5:
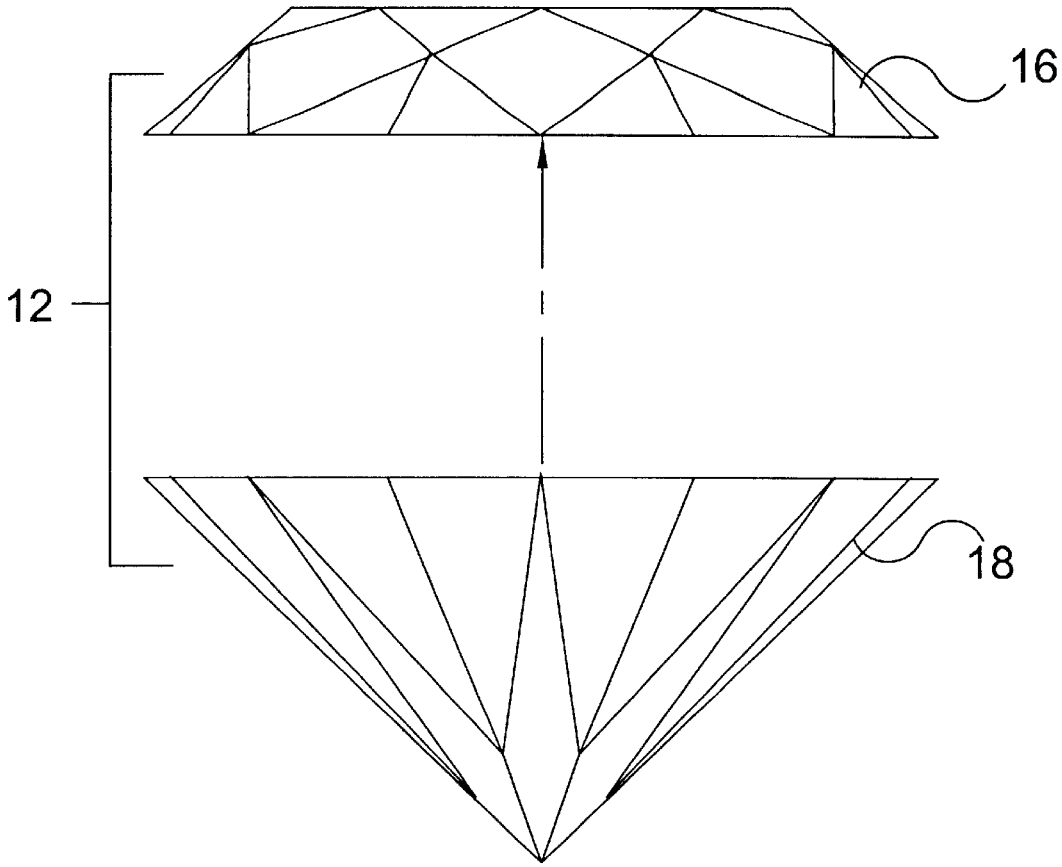
FIG. 5 is a side view of the cleaved primary stone in accordance with the method of the present invention.

Upon selecting the primary stone 12 in step S1, a jeweler may now determine the appropriate horizontal cutting plane of the primary stone 12 as discussed in step S2. FIG. 4 is a side view of the stone 12 showing the horizontal plane along which the stone is to be cleaved. The primary stone 12 will be cleaved on a horizontal axis, as illustrated in FIG. 5 and described in step S3, creating an upper portion 16 and a lower portion 18 of the primary stone 12. A cutting plane is to be selected according to the type of gemstone and the desired effect of the finished product S2. The cutting plane must be at a position in which sufficient material remains in the lower portion 18 for creating a cavity 20 for placing the secondary stone 14. Once the cutting plane is selected S2, the selected primary stone 12 is cleaved into an upper portion 16 and a lower portion 18 S3, as illustrated in FIG. 5.

Figure 6:
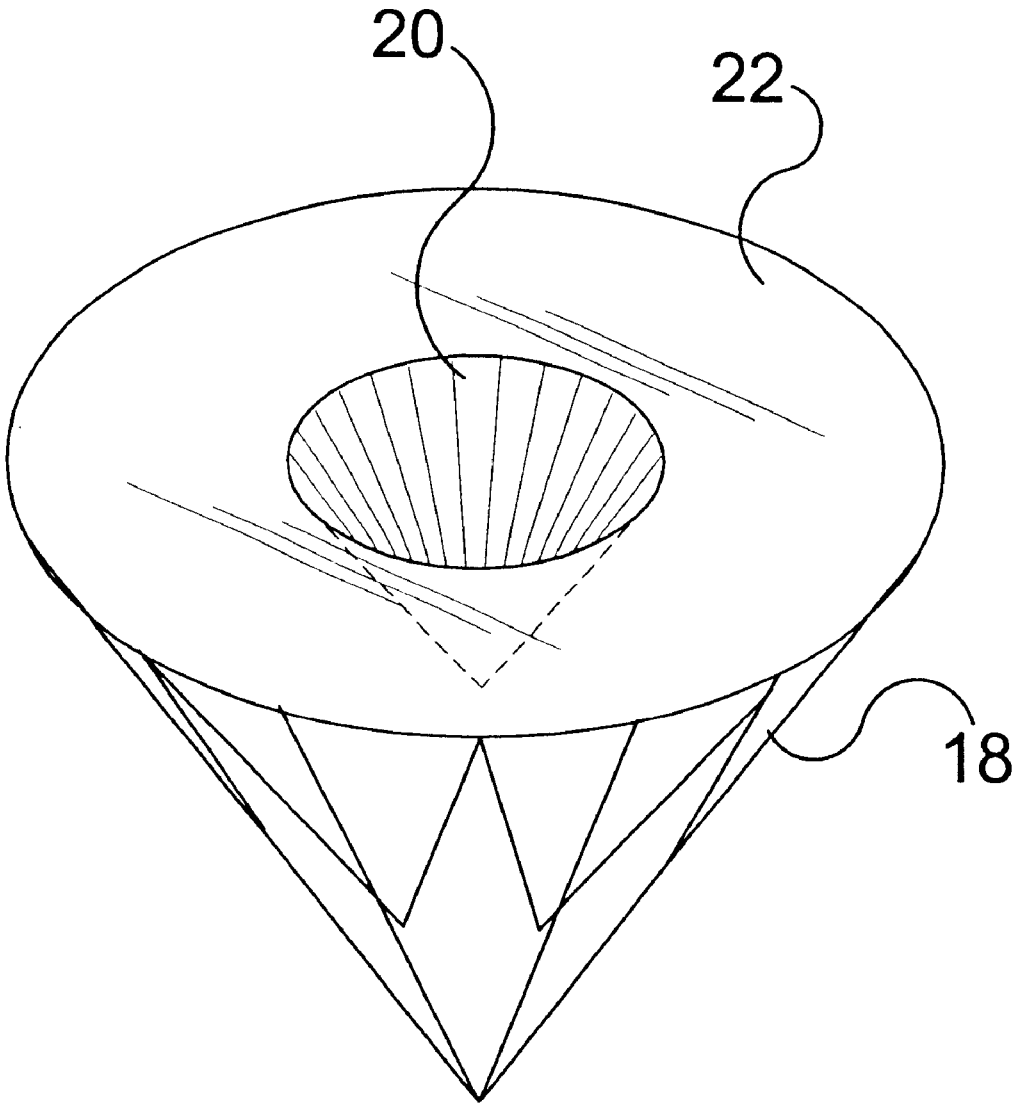
FIG. 6 is a perspective view of a cavitized primary stone in accordance with the method of the present invention.

The depth and breadth of the cavity 20, as illustrated in FIG. 6, to be bored for accommodating the secondary gemstone 14 is then calculated as stated in step S4. The cavity 20 must be of a depth such that, once the secondary stone 14 is positioned therein, it is completely submerged beneath the planar surface 22 of the lower portion of the primary stone 18. The breadth of the cavity 20 may be sized for a snug fit of the secondary stone 14 or may be oversized allowing for free movement of the encapsulated secondary stone 14. This free movement allows for a unique and more brilliant reflection of light that changes with the movement of the gemstone. The cavity 20 is then bored into the planar surface 22 of the lower portion of the primary stone 18 in accordance with the calculated depth and breadth as dicussed in step S5.

The secondary stone 14 is then selected for placement within the cavity 20 as stated in step S6. The secondary stone 14 may be of any color, clarity or cut depending upon personal preferences. The secondary stone 14 must be of adequate size to fit within the cavity 20 bored into the lower portion of the primary stone 18.

Alternatively, the secondary stone 14 may be selected prior to calculation and boring of the cavity. When selecting the secondary stone 14 prior to calculating the size of the cavity, the secondary stone 14 may be considered when calculating the size of the cavity 20.

The selected secondary stone 14 is then placed within the cavity 20 as described in step S7. A bonding agent 24 is now applied to the planar surface 22 of the lower portion of the primary stone 18 as discussed in step S8, and illustrated in FIG. 9. The bonding agent 24 may also be applied to the planar surface 22 of the upper portion of the primary stone. The planar surfaces 22 of both the upper and lower portions of the primary stone, 16 and 18 respectively, are now placed together, whereby the bonding agent 24 is able to adhere and secure the upper and lower portions 16 and 18 together, thus, encapsulating the secondary stone 14 between the two portions of the primary stone 16 and 18 as stated in step S9.

FIG. 3 is an illustrative view of a person 26 selecting a stone. Creating the decorative jewelry stone 10 requires the use of two gemstones. Selecting a stone requires one to consider the carat weight, color, clarity, and cut of a potential gemstone. In evaluating these characteristics of a potential gemstone, the consumer should keep in mind that the procedure for creating the combined embodiment 10 will require a mostly transparent primary stone 12, and that the carat weight of the primary stone 12 will be reduced by the method of the present invention. Additionally, the size of the secondary stone 14 must be able to fit the calculated size of the bored cavity 20 in the planar surface 22 of the lower portion of the primary stone 18. The potential size of the cavity may be calculated and a secondary stone 14 selected based upon the calculations. Alternatively, the secondary stone 14 may be selected and the size of the cavity calculated to accommodate the selected secondary stone.

FIG. 4 is a side view of the primary stone 12. The primary stone 12 is a faceted stone that is substantially transparent and may be faceted in a suitable configuration. A cutting plane is to be selected according to the stone and the desired effect of the finished product. Two alternate cutting planes are shown, cutting plane A and cutting plane B. A cutting plane may be determined at any point between cutting plane A and B provided that there is sufficient material remaining in the portion of the primary stone 18 within which the cavity 20 is to be bored for accommodating the secondary stone 14.

FIG. 5 is a side view of the cleaved primary stone 12. The primary stone 12 is cleaved along the selected cutting plane. Once cleaved, the primary stone is divided into two separate parts, the upper portion 16 and the lower portion 18. The upper portion 16 is separated from the lower portion 18, as illustrated by the arrow pointing away from the lower portion 18.

FIG. 6 is a perspective view of a cavitized primary stone 12. As illustrated, a cavity 20 is bored into the planar surface 22 of the lower portion of the primary stone 18 once the upper portion 16 is removed there from. The cavity may alternatively be bored into the upper portion 16. The parameters of the cavity 20 are selected accordingly with regard to the size and shape of the secondary stone 14 and an appropriatly-sized cavity is bored into the planar surface of the primary stone. The cavity 20 is to be deep enough so that, once positioned therein, the secondary stone 14 is completely submerged beneath the planar surface 22 of the lower portion of the primary stone 18. The breadth of the cavity 20 may be sized for a snug fit of the secondary stone 14 or may be oversized allowing for free movement of the encapsulated secondary stone 14. This free movement allows for a unique and more brilliant reflection of light that changes with the movement of the gemstone.

Figure 7:
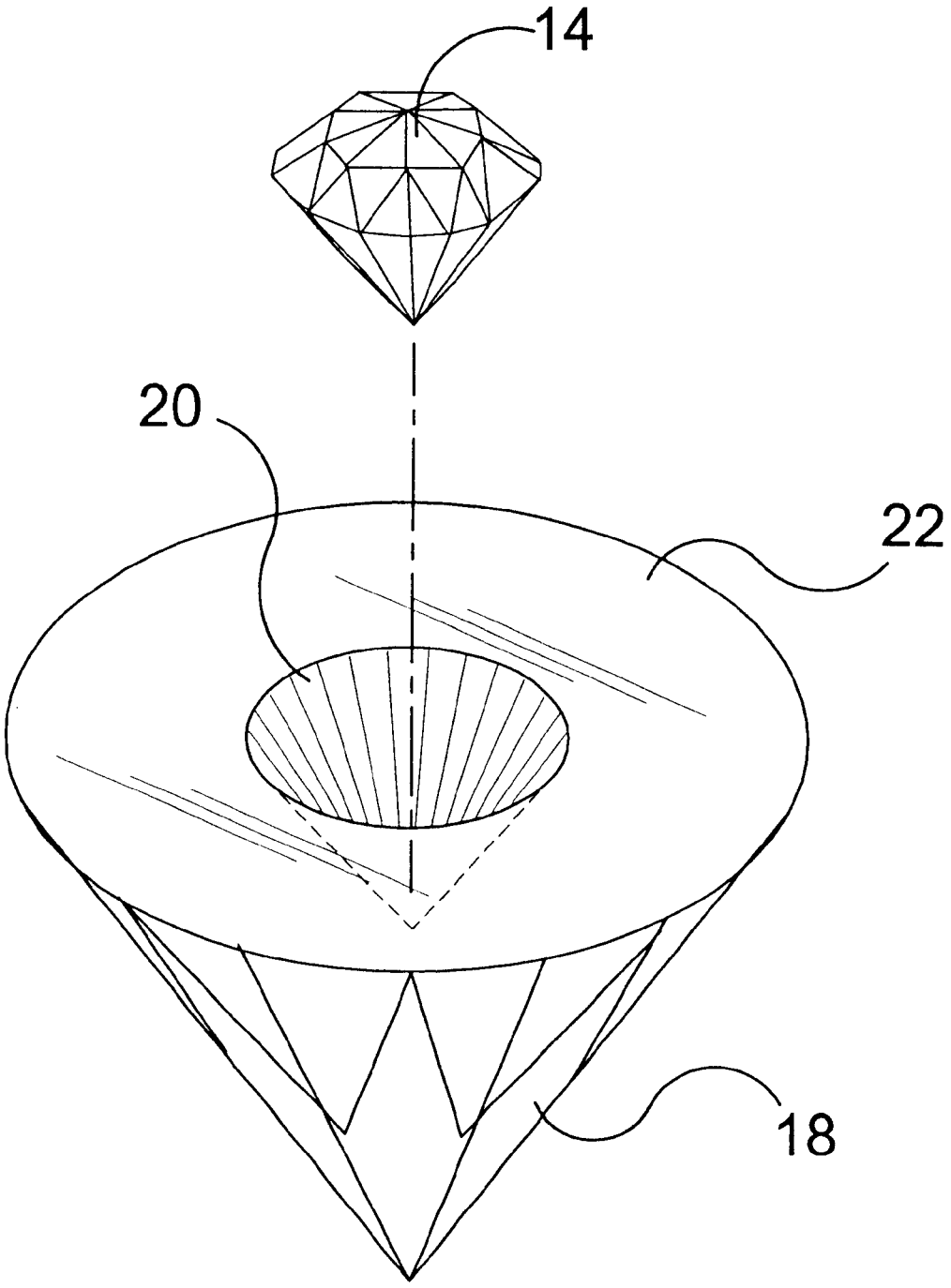
FIG. 7 is a perspective view of the secondary stone being positioned into the cavity bored into the planar surface of the lower portion of the primary stone in accordance with the method of the present invention.

FIG. 7 is a perspective view of a selected secondary stone 14 being positioned into the cavity 20 bored into the planar surface 22 of the lower portion of the primary stone 18. The secondary stone 14 may be of any color, clarity or cut depending upon personal preferences. The secondary stone 14 must be of adequate size to fit within the cavity 20 bored into the lower portion of the primary stone 18.

Figure 8:
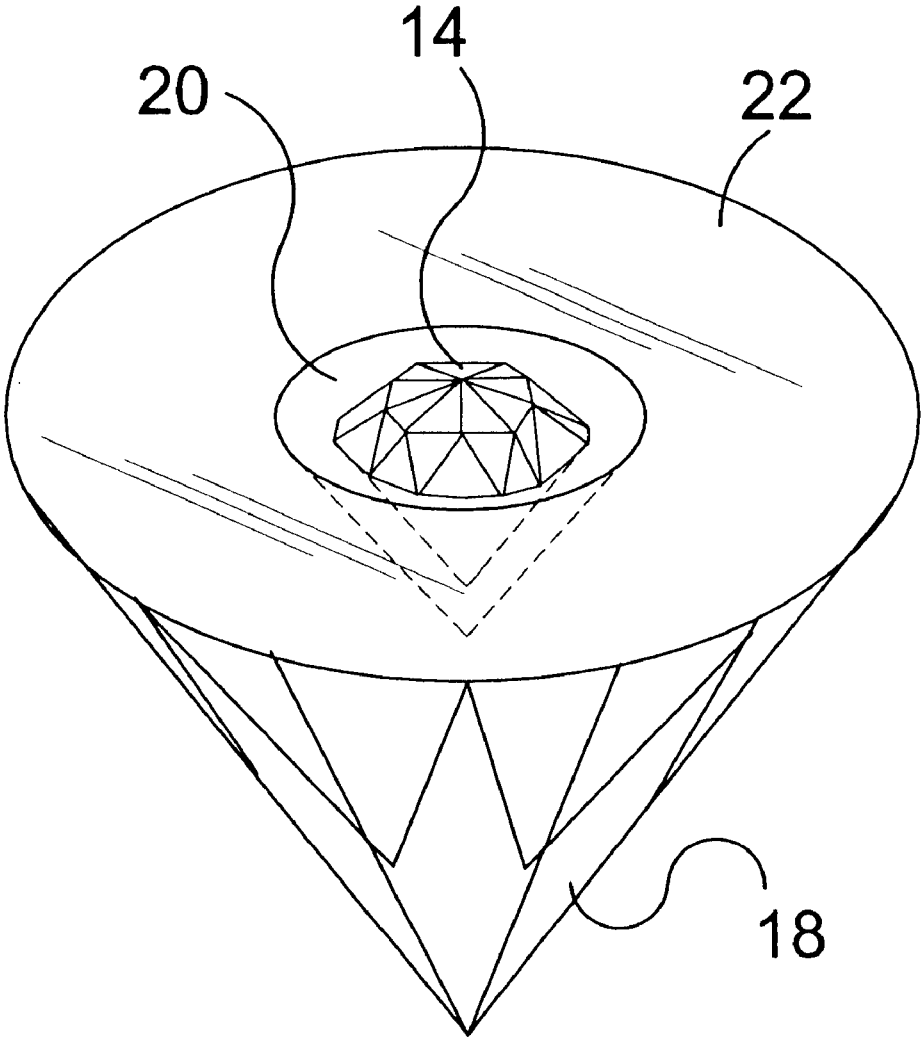
FIG. 8 is a perspective view of the secondary stone positioned within the cavity of the lower portion of the primary stone in accordance with the method of the present invention.

FIG. 8 is a perspective view of the secondary stone 14 positioned inside the lower portion of the primary stone 18. The secondary stone 14 is placed entirely within the cavity 20 of the lower portion of the primary stone 12 so as not to protrude from the planar surface 22.

Figure 9:
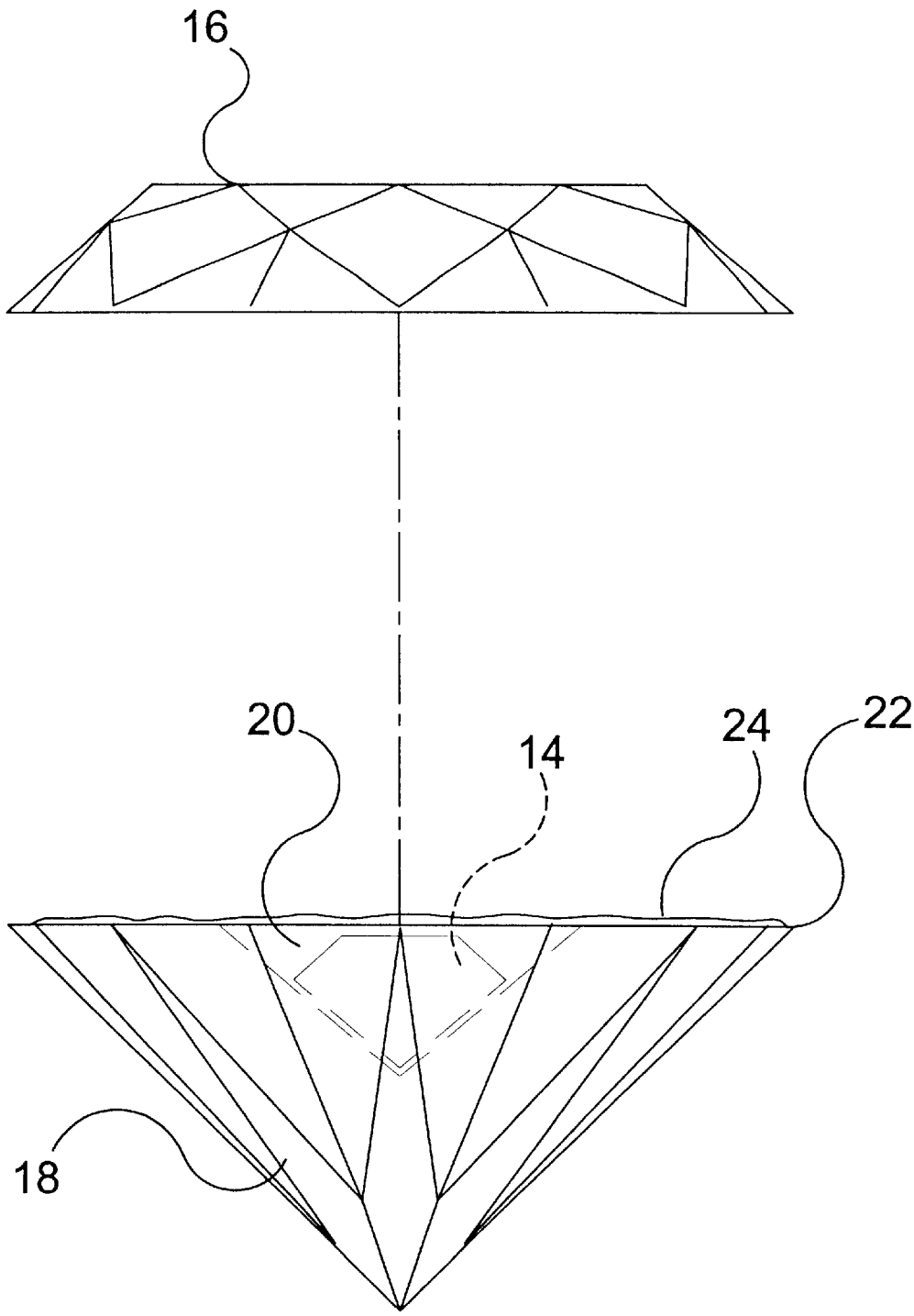
FIG. 9 is a side view of the secondary stone being encased within the cavity of the lower portion of the primary stone by sealing the lower portion to the upper portion with a bonding agent in accordance with the method of the present invention.

FIG. 9 is a side view of the secondary stone 14 being encased within the cavity 20 of the lower portion of the primary stone 18 by sealing the lower portion 18 to the upper portion 16 with a clear bonding agent 24. The bonding agent 24 is placed on the planar surface 22 of the lower portion of the primary stone 18. Preferably the bonding agent is an optically clear UV curing agent or a heat-curing agent thereby masking the cut between the upper and lower portions of the primary stone 12. The secondary stone 14 does not protrude from the planar surface 22 of the lower portion of the primary stone 18 so as not to prevent a flush contact between the planar surfaces of the upper portion 16 and the lower portion 18.

Figure 10:
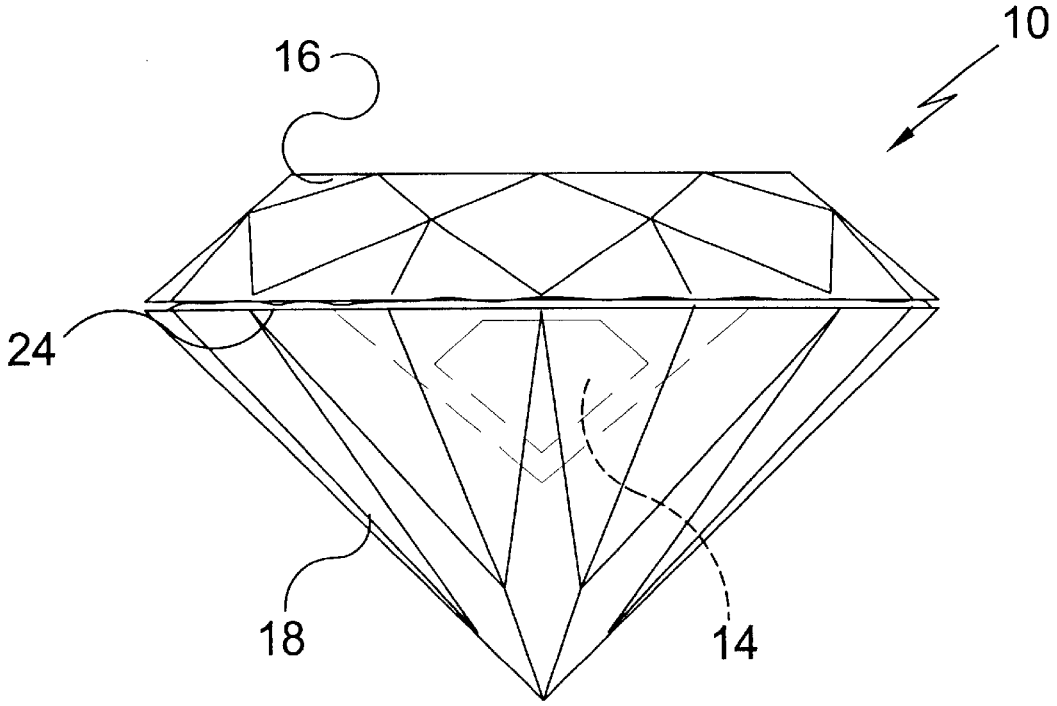
FIG. 10 is a side view of the secondary stone sealed within the primary stone according to the method of the present invention.

FIG. 10 is a side view of the secondary stone positioned within the cavity of the lower portion of the primary stone 18. The planar surfaces 22 of both the upper and lower portions of the primary stone, 16 and 18 respectively, are mated, thus, encapsulating the secondary stone 14 between the two portions of the primary stone 16 and 18. The bonding agent 24 cures to form a single unit 10. Because the upper portion of the primary stone 16 is bonded to the lower portion of the same primary stone 18 the bond is undetectable to the naked eye.

Figure 11:
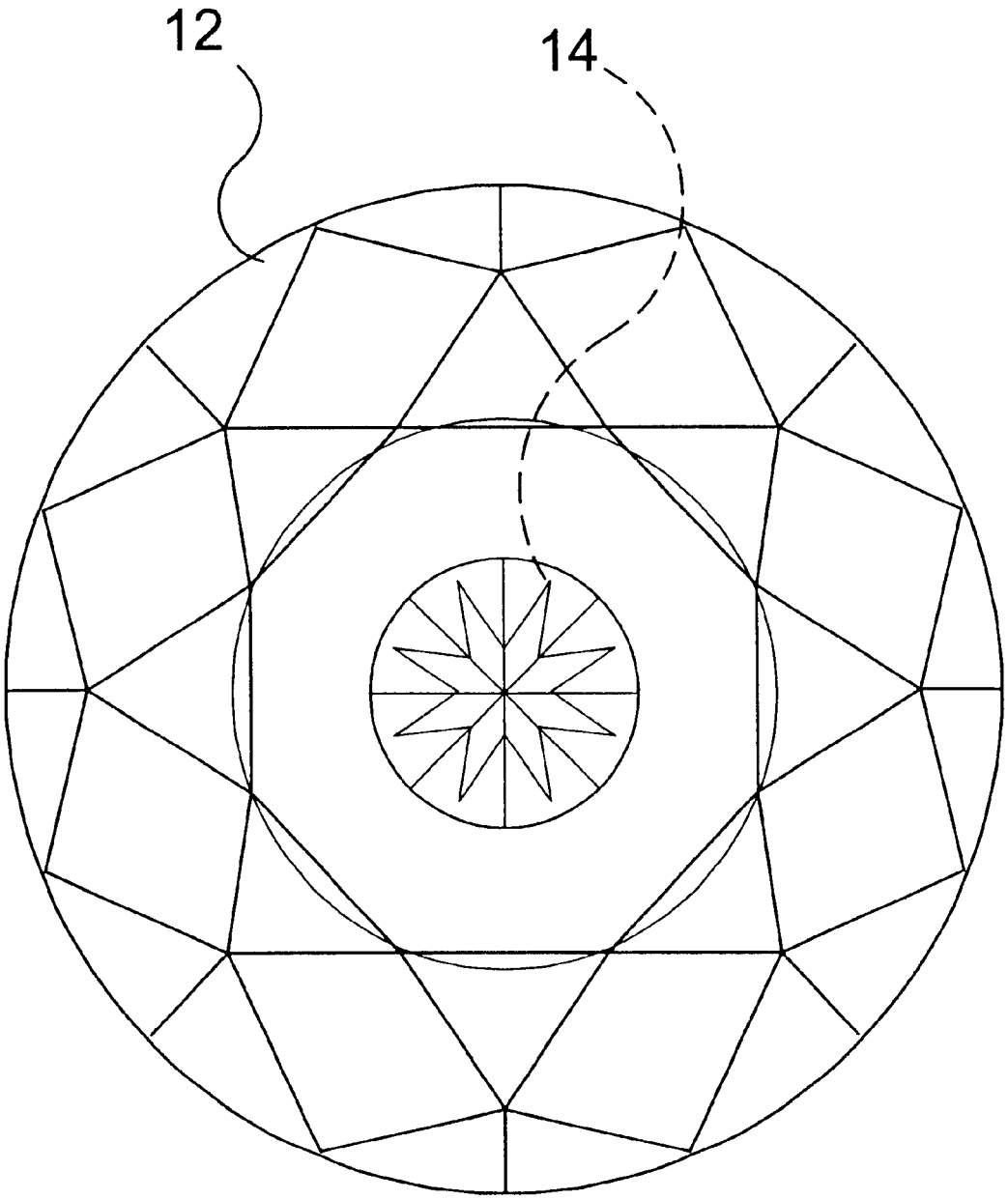
FIG. 11 is a top view of the secondary stone sealed within the primary stone according to the method of the present invention.

FIG. 11 is a top view of the designer jewelry stone made as a result of the process of the present invention. The secondary stone 14 is secured within the interior cavity 20 of the primary stone 12 thereby using the juxtaposition of the two faceted stones 12 and 14 to form a unique pattern and effect.

It will be understood that each of the elements described above, or two or more together may also find a useful application in other types of methods differing from the type described above.

While certain novel features have been shown and described and are pointed out in the annexed claims, it is not attended to be limited to the details above, since it will be understood that various omissions, modifications, substitutions, and changes in forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic aspects of this invention.

What is new and desired to be protected by Letters Patent is set in the appended claims:

1. A process for developing a decorative jewelry stone comprising:

a) providing a primary stone;

b) defining a cutting plane on said primary stone;

c) cleaving said primary stone at said cutting plane to produce first and second portions, each of said first and second portions having a planar surface;

d) boring a cavity into the planar surface of one of said first and second portions of said primary stone;

e) placing a secondary stone within said cavity, said cavity being dimensioned to be substantially equal to a size of the secondary stone so that said secondary stone fits tightly within said cavity;

f) applying a bonding agent on said planar surfaces of one of said first and second portions; and g) placing said planar surfaces of said first and second portions against one another allowing said bonding agent to cure and thereby permanently fix said first and second portions together sealing said secondary stone therebetween.

2. The method according to claim 1, wherein said bonding agent is selected from the group consisting of a transparent UV curing agent and a transparent heat-curing agent.

3. The method according to claim 1, further including the step of faceting an outer surface of said primary stone prior to cleaving.

4. The method according to claim 1, wherein said primary stone is any one of a natural, synthetic or simulant type of gemstone.

5. The method according to claim 4, wherein said secondary stone is the same type of gemstone as said primary stone.

6. A method according to claim 4, wherein said secondary stone is a different type of gemstone as said primary stone.

* * * * *